US009487872B2

(12) United States Patent
Kelly et al.

(10) Patent No.: US 9,487,872 B2
(45) Date of Patent: Nov. 8, 2016

(54) ELECTROLYTIC CELL, METHOD FOR ENHANCING ELECTROLYTIC CELL PERFORMANCE, AND HYDROGEN FUELING SYSTEM

(75) Inventors: Nelson A. Kelly, Sterling Heights, MI (US); Andrew M. Mance, Royal Oak, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 343 days.

(21) Appl. No.: 13/537,458

(22) Filed: Jun. 29, 2012

(65) Prior Publication Data

US 2014/0001035 A1 Jan. 2, 2014

(51) Int. Cl.

| | |
|---|---|
| ***C25B 1/04*** | (2006.01) |
| ***C25B 9/00*** | (2006.01) |
| ***C25B 1/00*** | (2006.01) |
| ***C25B 11/02*** | (2006.01) |
| ***C25B 15/02*** | (2006.01) |
| ***C25B 9/08*** | (2006.01) |

(52) U.S. Cl.

CPC ..... *C25B 11/02* (2013.01); *C25B 9/08* (2013.01); *C25B 15/02* (2013.01); *Y10T 29/49002* (2015.01)

(58) Field of Classification Search

CPC ..... C25B 1/04; C25B 9/00; C25B 1/00
USPC ..... 204/242, 280, 283, 284, 674
See application file for complete search history.

(56) References Cited

U.S. PATENT DOCUMENTS 3,352,774 A * 11/1967 Williams ..... B23H 3/04 204/224 R
3,361,656 A * 1/1968 Miller ..... 205/549
4,336,122 A * 6/1982 Spirig ..... 204/222

(Continued)

OTHER PUBLICATIONS

Walton, D. J., et al., "Sonoelectrochemistry: Chlorine, Hydrogen and Oxygen Evolution at Platinised Platinum", Electrochimica Acta, vol. 4, No. 17, 1996, pp. 2747-2751.

(Continued)

*Primary Examiner* — Zulmariam Mendez
(74) *Attorney, Agent, or Firm* — Dierker & Kavanaugh, P.C.

(57) ABSTRACT

An electrolytic cell includes a positive electrode disposed in an electrolytic compartment, a negative electrode disposed in another electrolytic compartment, and a cell membrane positioned between the electrolytic compartment and the other electrolytic compartment. An electrolyte solution is disposed inside the electrolytic compartment and inside the other electrolytic compartment. The electrolyte solution is also in contact with the cell membrane. A transducer, which is directly attached to any of the negative electrode or the positive electrode, is capable of selectively transmitting vibrational energy to the negative electrode and/or the positive electrode. The vibrational energy selectively transmitted to the negative electrode and/or the positive electrode causes bubbles to form and to separate i) hydrogen gas bubbles from a surface of the negative electrode, ii) oxygen gas bubbles from a surface of the positive electrode, or iii) both i and ii.

24 Claims, 3 Drawing Sheets

(56) References Cited

U.S. PATENT DOCUMENTS

| | | | | |
|---|---|---|---|---|
| 5,399,251 | A | 3/1995 | Nakamats | |
| 5,840,172 | A * | 11/1998 | Zugravu | 205/639 |
| 7,104,217 | B2 * | 9/2006 | Himori et al. | 118/723 E |
| 7,147,821 | B1 * | 12/2006 | Drean | 422/4 |
| 7,459,071 | B2 | 12/2008 | Omasa | |
| 7,909,968 | B2 | 3/2011 | Hallenbeck | |
| 2010/0000876 | A1 | 1/2010 | Kirchoff et al. | |
| 2010/0276299 | A1 | 11/2010 | Kelly et al. | |
| 2011/0139630 | A1 | 6/2011 | Omasa | |
| 2011/0146599 | A1 * | 6/2011 | Sciban et al. | 123/3 |
| 2012/0058405 | A1 * | 3/2012 | Kirchoff et al. | 429/422 |

OTHER PUBLICATIONS

Mat, Mahmut D., et al., "A two-phase flow model for hydrogen evolution in an electrochemical cell", Int'l Journal of Hydrogen Energy 29, 2004, pp. 1015-1023.

Kelly, Nelson A., et al., "A solar-powered, high-efficiency hydrogen fueling system using high-pressure electrolysis of water: Design and initial results", Int'l Journal of Hydrogen Energy 33, 2008, pp. 2747-2764.

* cited by examiner

ELECTROLYTIC CELL, METHOD FOR ENHANCING ELECTROLYTIC CELL PERFORMANCE, AND HYDROGEN FUELING SYSTEM

TECHNICAL FIELD

The present disclosure relates generally to electrolytic cells, methods for enhancing electrolytic cell performance, and hydrogen fueling systems.

BACKGROUND

Alkaline electrolyzers are electrolytic cells, and include positive and negative electrodes that are separated by a membrane that allows transport of ions through an electrolyte solution. During use of an alkaline electrolyzer, hydrogen gas and oxygen gas may be respectively produced at the negative electrode (e.g., the cathode) and at the positive electrode (e.g., the anode) when an electric current (e.g., a DC current) is applied to the electrodes. The positive electrode and the negative electrode are each contained in separate compartments of the electrolyzer. The hydrogen and oxygen gases form bubbles at the negative electrode surface and the positive electrode surface, respectively, and in the electrolyte solution, and the bubbles will rise to the top of their respective electrolytic cell compartments. The hydrogen gas may then be collected in a hydrogen storage container, which may be used as fuel to power, e.g., a fuel-cell electric vehicle (FCEV).

SUMMARY

Examples of an electrolytic cell are disclosed herein. In one example of the electrolytic cell, a positive electrode is disposed in an electrolytic compartment, a negative electrode is disposed in another electrolytic compartment, and a cell membrane is positioned between the electrolytic compartment with the positive electrode disposed therein and the other electrolytic compartment with the negative electrode disposed therein. An electrolyte solution is disposed inside the electrolytic compartment with the positive electrode disposed therein and inside the other electrolytic compartment with the negative electrode disposed therein, and the electrolyte solution is also in contact with the cell membrane. A transducer is directly attached to any of the positive electrode or the negative electrode. Vibrational energy transmitted to the positive electrode and/or the negative electrode by the transducer causes bubbles to form and to separate i) hydrogen gas bubbles from a surface of the negative electrode, ii) oxygen gas bubbles from a surface of the positive electrode, or iii) both i and ii.

Also disclosed herein are examples of a method for enhancing electrolytic cell performance, and examples of a hydrogen fueling system.

BRIEF DESCRIPTION OF THE DRAWINGS

Features and advantages of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

FIG. 5C-1 is an enlarged view of a portion of the positive electrode of FIG. 5C.

DETAILED DESCRIPTION

Electrolytic cells disclosed herein utilize water electrolysis to generate hydrogen gas that may be used as fuel, for example, to power a FCEV or other systems that utilize hydrogen gas as fuel, such as auxiliary power systems. For instance, fuel cells powered by hydrogen gas may be used to generate direct current (DC) electricity similar to a battery. However, rather than being recharged, fuel cells powered by hydrogen gas may be re-fueled by adding hydrogen gas to a storage container. Additionally, in some instances, these fuel cells may degrade at a slower rate compared to batteries.

Electrolytic cells that utilize water electrolysis to generate hydrogen may also be used in homes or buildings, e.g., for domestic load leveling.

Water electrolysis generally occurs by splitting water molecules in the presence of an applied electric current (e.g., a DC current generated by a DC power supply). The water electrolysis reaction produces hydrogen and oxygen atoms on respective electrode surfaces. The hydrogen and oxygen atoms will thereafter form hydrogen and oxygen gas molecules (i.e., $H_2$ and $O_2$), and these gas molecules will eventually dissolve into spaces defined between individual water molecules of an electrolyte solution. At some point, the hydrogen and oxygen gas molecules will group together, and the respective groups will be surrounded by structures of intermolecular-bound water molecules defined in the electrolyte solution formed, at least in part, because of the surface tension of the water. The respective hydrogen and oxygen gas groups will thereafter become hydrogen and oxygen gas bubbles in the electrolyte solution. Further, the gas bubbles will typically congregate near or on the positive and/or negative electrodes of the electrolytic cell, where the positive electrode and the negative electrode are disposed in their respective electrolytic compartments. Accordingly, the water electrolysis reaction produces gas bubbles in the electrolyte solution of the cell and at or on the electrodes in each compartment of the electrolytic cell. In time, the gas bubbles will rise to the top of the respective compartments of the electrolytic cell due, at least in part, to their buoyancy inside the electrolyte solution. Upon reaching the top of the compartments, the gases may exit their respective compartments. The hydrogen gas may then be collected in a storage container, while the oxygen gas may be vented to the atmosphere.

Figure 1:
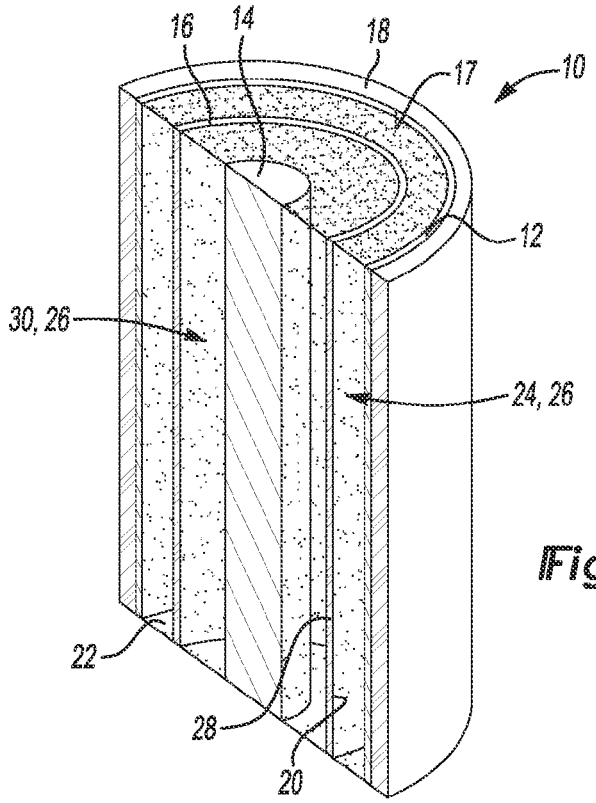
FIG. 1 is a cross-sectional, semi-schematic perspective view of an example of an electrolytic cell.

Some hydrogen fueling systems, e.g., FCEV, require high pressure hydrogen gas as a fuel. The high pressure hydrogen gas may be required, for example, to increase the storage capacity of hydrogen onboard the FCEV. In an example, high pressure hydrogen gas may be produced utilizing an alkaline electrolytic cell, an example of which is shown in FIG. 1. While an alkaline electrolytic cell is depicted in FIG. 1, it is believed that the examples disclosed herein may be included in other electrolyzers as well.

The electrolytic cell 10 of FIG. 1 is a cylindrical cell that includes a cylindrical negative electrode 12 surrounding a positive electrode 14, which in this example is in the shape of a rod. It is to be understood that the positive electrode 14 may have another geometric shape, such as a cuboid, a hexagonal prism, a triangular prism, a cone, etc. Further, the cylindrical negative electrode 12 may have a circular shape (as shown in FIG. 1), a triangular shape, a rectangular shape, a polygonal shape, etc. A cell membrane 16 is positioned between the cylindrical negative electrode 12 and the positive electrode rod 14. As shown in FIG. 1, the negative electrode 12 is positioned adjacent to an inner surface 17 of a non-conductive wall 18. In this example, the wall 18, an outer surface 20 of the cell membrane 16, and a base 22 of the electrolytic cell 10 defines a compartment 24 within which an electrolyte solution 26 is disposed. In this example configuration, the negative electrode 12 is disposed inside the compartment 24 as well. In another example, the inner surface 17 of the wall 18 is the negative electrode 12, and the compartment 24 is then defined by the negative electrode 12, the base 22, and the outer surface 20 of the cell membrane 16.

An inner surface 28 of the cell membrane 16 and the base 22 defines another compartment 30 within which the electrolyte solution 26 is also disposed. In an example of this configuration, the base 22 may be formed from a conductive or a semi-conductive material, and the positive electrode 14 is also disposed inside the other compartment 30, and is connected to the base 22 utilizing non-conducting washers or the like. In another example of this configuration, the base 22 is formed from a non-conductive material, and the positive electrode 14 is disposed inside the other compartment 30, and is connected directly to the non-conductive base 22.

Further, the compartments 24, 30 are gas-tight compartments; whereby gases produced during electrolysis (e.g., hydrogen gas and oxygen gas) do not mix with one another. Rather, when the gases are produced, the gases stay in their respective, separate compartments 24, 30. As is discussed further herein, gas tight compartments may be obtained by the selection of the cell membrane 16 and through the use of sonication, which enhances bubble formation to force produced gases to the surface of the cell for removal. Gas transport and removal keeps the gases from diffusing through the cell membrane 16 at periods of gas supersaturation.

Typically, the chemical and physical characteristics of the cell membrane 16 will affect the operation of the electrolytic cell 10. In an example, the cell membrane 16 is made of an organic-based, polymeric material that is porous, where the porosity of the membrane 16 will enable ionic transport through the membrane 16 and resist gas transport through the membrane 16. The polymeric material of the membrane 16 is also chosen from a material that will not be deleteriously affected by the electrolyte solution 26, which may be alkaline. One example of a polymeric material that may be used for the cell membrane 16 is polyethylene. In this example, the pore size and the hydrophobic/hydrophilic properties of the polyethylene membrane may be optimized by treating the membrane 16 to permit facile ion passage and to reduce gas permeability. For instance, the membrane 16 may be chemically treated to impart hydrophobic or hydrophilic qualities to the membrane 16. For instance, the membrane 16 may be treated to oxidize the surface of the membrane 16 to impart a wetting property. This may be accomplished by partial oxidation of the membrane 16 utilizing plasma, a controlled flame, or an electric discharge. Partial oxidation may also be accomplished by gamma ray irradiation in an oxygen atmosphere, or in some instances, utilizing a deep ultraviolet ray (e.g., at about a 254 nm wavelength) in an oxygen atmosphere. It is to be understood that partial oxidation should be controlled, in part because the partial oxidation method used may produce free radicals which may, in some instances, be undesirable in the system.

It is to be understood, however, that the cell membrane 16 does not have to be surface treated in instances where an electrolyte solution 26 of the cell 10 is sufficient to wet the membrane 16 surface. For example, alkaline electrolytes tend to sufficiently wet polyethylene, and in these instances, a polyethylene cell membrane may not require any surface treatment(s).

As briefly mentioned above and as will be described further herein, in the examples disclosed herein, the cell 10 is designed so that the cell membrane 16 allows ionic transport between the positive electrode 14 and the negative electrode 12, and so that gas transport across the cell membrane 16 is reduced or eliminated. Reduction or elimination of gas transport across the cell membrane 16 is accomplished, at least in part, by the generation of gas bubbles at or on the electrode 12, 14, where such gas bubbles rise to the top and out of the electrolytic cell 10 rather than diffuse through the membrane 16. In this way, the combination of the cell membrane 16, the base 22, and the electrode 12 forms a relatively gas-tight hydrogen gas compartment 24, and the combination of the cell membrane 16, the base 22, and the electrode 14 forms a relatively gas-tight oxygen gas compartment 30.

Further, eliminating hydrogen gas permeation through the cell membrane 16 advantageously keeps the hydrogen gas (at the negative electrode 12) from exothermally combining with the oxygen gas (at the positive electrode 14), and thus improves gas purity, reduces or eliminates elastomeric hose failure at the surface of the electrolytic cell 10, and results in higher pressure operations and a higher yield of usable hydrogen gas.

The electrolyte solution 26 is disposed between the negative electrode 12 and the positive electrode 14. In other words, the electrolyte solution 26 is disposed in the compartment 24 within which the negative electrode 12 is disposed and in the compartment 30 within which the positive electrode 14 is disposed. The electrolyte solution 26 is also in contact with the cell membrane 16. For high pressure hydrogen gas production, the electrolyte solution 26 may contain an alkaline electrolyte that is added to water. Examples of the alkaline electrolyte include potassium hydroxide (KOH) and sodium hydroxide (NaOH).

Figure 2:
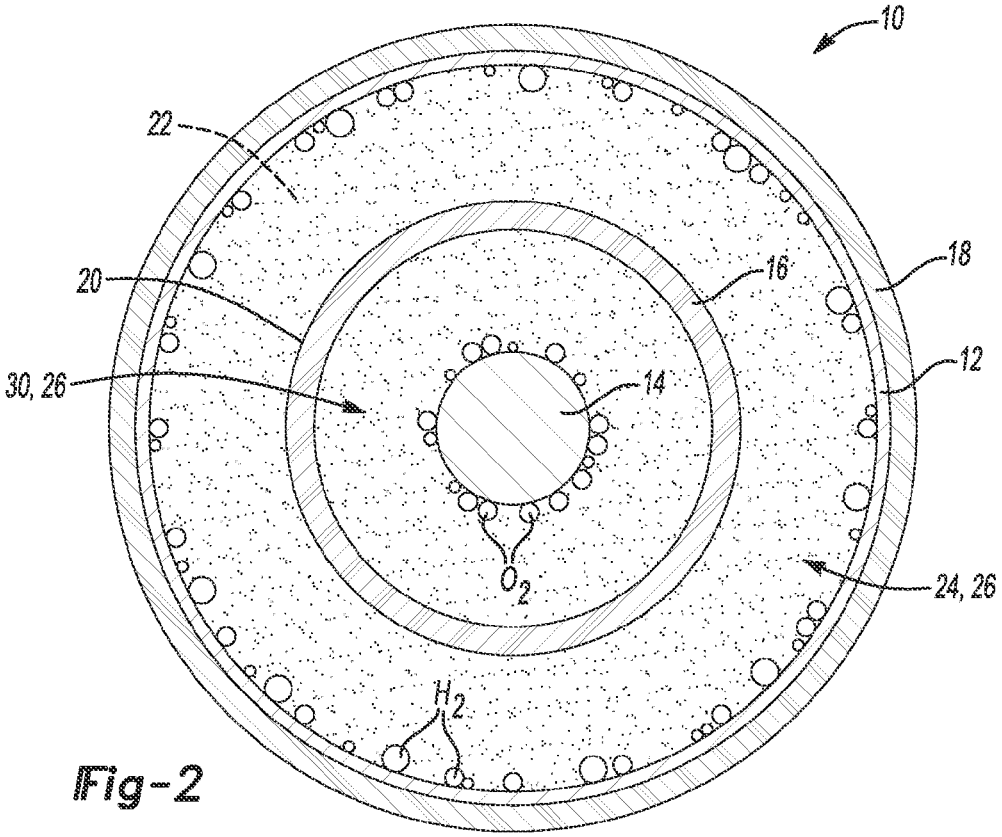
FIG. 2 is a cross-sectional top view of an example of the electrolytic cell including gas bubbles formed adjacent to the positive and negative electrodes of the electrolytic cell.

During electrolysis, hydrogen gas bubbles form on or near the negative electrode 12, and oxygen gas bubbles form on or near the positive electrode 14. This is shown in FIG. 2, where the hydrogen gas bubbles are shown as circles labeled $H_2$ and the oxygen gas bubbles are shown as circles labeled $O_2$. In time, the hydrogen gas bubbles $H_2$ and the oxygen gas $O_2$ bubbles rise to the top of the electrolyte solution 26 in their respective compartments 24, 30. As will be described in further detail below in conjunction with FIG. 6, the hydrogen gas $H_2$ produced by the electrolytic cell 10 may be collected in a hydrogen storage container 32.

The water electrolysis performed by the electrolytic cell 10 may be used to produce high pressure hydrogen gas (e.g., the pressure increases over time as an electric current passes through the electrolytic cell 10). Thus, the electrolytic cell 10 may be referred to as a high pressure electrolytic cell. In an example, it may be desirable that the high pressure electrolytic cell 10 contain and ultimately output hydrogen at a pressure value of about 10,000 psi, while in another example, it may be desirable that the high pressure electrolytic cell 10 contain and ultimately output hydrogen at a pressure value of about 6,500 psi. In yet another example, the high pressure electrolytic cell 10 may contain and ultimately output hydrogen at a pressure value ranging from about 2,000 psi to about 5,000 psi. It is to be understood that the electrolytic cell 10 can operate at these high pressures by containing the hydrogen and oxygen gases that are produced in the respective compartments 24, 30 of the electrolytic cell 10 until a desired pressure of the cell 10 is reached. In an example, the cell 10 may contain back-pressure regulators for each compartment 24, 30 (not shown) to maintain a given high upstream pressure, and which may allow hydrogen gas and oxygen gas to exit the respective compartments 24, 30 once the pressure inside those compartments 24, 30 exceeds a threshold pressure value. The oxygen gas that exits the cell 10 is vented from the compartment 30 through an oxygen exit port 36 (see FIG. 3), while the hydrogen gas that exits the cell 10 through a hydrogen exit port 34 (see FIG. 3) is collected, e.g., in the storage container 32.

In an example, the pressure inside each of the compartments 24, 30 is balanced, e.g., within a few inches of water. In this way, one can prevent the electrolyte 26 from being pushed out of one compartment 24, 30 by a higher pressure present in the other compartment 24, 30. By balancing the pressures, a smaller amount of hydrogen gas will permeate through the cell membrane 16 and into the oxygen gas compartment 30.

The water electrolysis performed by the electrolytic cell 10 will now be described herein. In an example, hydrogen gas $H_2$ may be produced at the negative electrode 12 (again, as shown in FIG. 2) utilizing the electrolyte solution 26 (containing an alkaline electrolyte and water) by a reduction half reaction shown in Equation 1. This reaction occurs in the electrolytic compartment 24 (i.e., the cathode cell compartment) of the cell 10:

$$2H_2O+2e^- \rightarrow H_2+2OH^- \quad \text{(Eqn. 1)}$$

Oxygen gas $O_2$ may be produced at the positive electrode 14 (as shown in FIG. 2) utilizing the electrolyte solution 26 by an oxidation half reaction shown in Equation 2. This reaction occurs in the electrolytic compartment 30 (i.e., the anode cell compartment) of the cell 10.

$$2OH^- \rightarrow \tfrac{1}{2}O_2+H_2O+2e^- \quad \text{(Eqn. 2)}$$

The half reactions shown in Equations 1 and 2 may then be combined to form a hydrogen evolution reaction (HER) and an oxygen evolution reaction (OER), as shown in Equation 3.

$$H_2O_{(l)} \rightarrow H_2+\tfrac{1}{2}O_2 \quad \text{(Eqn. 3)}$$

In Equation 3, water ($H_2O$) is reacted while in the liquid state (as denoted by the lower case l), and hydrogen ($H_2$) and oxygen ($O_2$) gases are produced under standard temperature (e.g., 25° C.) and pressure (about 14.5 psi).

The performance of high pressure electrolytic cells, such as the electrolytic cell 10, may be defined by its efficiency. In an example, the efficiency of the cell 10 may be determined based on how the cell 10 converts electrical energy into chemical energy (i.e., hydrogen and oxygen). Since the hydrogen gas $H_2$ produced by the electrolytic cell 10 will be used as fuel (e.g., for a FCEV), the efficiency of the electrolytic cell 10 may be defined mainly by its chemical energy in the hydrogen gas production.

In an example, the efficiency of the electrolytic cell 10 may be defined as being proportional to its operating voltage ($V_{op}$), which is shown in Equation 4.

$$\text{Efficiency}=100\%\times(1.254\ V/V_{op}) \quad \text{(Eqn. 4)}$$

In Equation 4, $V_{op}$ is the operating voltage of the electrolytic cell 10, and 1.254 V is the lower heating value (LHV) of hydrogen, or the enthalpy for the reverse reaction in Equation 3 utilizing water vapor rather than liquid water. It is to be understood that the thermo neutral voltage (i.e., the higher heating value or HHV, which is 1.485 V) or the Gibbs free energy (i.e., 1.23 V) may be used in the numerator in Equation 4 instead of the LHV depending on the standard selected for evaluating the efficiency of the electrolytic cell 10. Further, the operating voltage ($V_{op}$) is a function of the hydrogen production rate, the temperature of the electrolytic cell, and the catalysis of the half reactions shown by Equations 1 and 2 above. The efficiency of the electrolytic cell 10 reduces when $V_{op}$ increases. Increases in $V_{op}$ may be referred to as overvoltages, which are voltages that are over the ideal thermodynamic value or limit. Factors that may influence overvoltages in the electrolytic cell 10 include the conductivity of the selected electrolyte, electrodes that catalyze the respective chemical reactions, and the current density at which the cell 10 is operated.

It is believed that the ideal thermodynamic limit for the water splitting voltage (i.e., the half reaction shown in Equation 1) is rarely reached in practice, in part because this voltage (which is the Gibbs free energy) is the reversible voltage ($V_{rev}$) for an infinitely slow process. In reality, water splitting voltage includes an overvoltage ($\eta$) that is required to drive the reaction to a finite rate. This is shown in Equation 5.

$$V=V_{rev}\eta \quad \text{(Eqn. 5)}$$

Furthermore, the overvoltage $\eta$ is determined by Equation 6, $$\eta=\eta_a\eta_c+\eta_{ir} \quad \text{(Eqn. 6)}$$

where $\eta_a$ is the activation overvoltage caused by rate limiting steps (e.g., activation energy barriers), $\eta_c$ is the concentration overvoltage caused by a decrease in concentration at the electrode surface relative to the bulk phase due to mass transport limitations, and $\eta_{ir}$ is the ohmic overvoltage caused mainly by resistance to ion flow through the electrolyte solution 26 and the cell membrane 16. It is to be understood that the ideal thermodynamic value or limit occurs, e.g., when no current is applied to the electrolytic cell 10, and thus the voltage potential difference across the electrodes 12, 14 is equal to the reversible voltage. Since some voltage potential is necessary during the operation of the cell 10, one may conclude that the overvoltage cannot be completely eliminated.

The inventors of the present disclosure have encountered certain issues with the formation of high pressure hydrogen gas by water electrolysis utilizing an alkaline electrolytic cell, such as the cell 10. For instance, it was found that during electrolysis, gas bubbles that formed in the electrolyte solution 26 congregated on and around the negative and positive electrodes 12, 14, as shown in FIG. 2. It is believed that the formation of the gas bubbles at the electrode 12, 14 surfaces, and the transport of the gas bubbles to the top of the electrolyte solution 26 and out of the electrolyte solution 26 present a barrier to the operation of high pressure electrolytic cells that is not represented by the reactions shown in Equations 1, 2, and 3, and the overvoltage of the cell 10 as represented by Equations 5, and 6. Furthermore, gas bubbles adhering to the electrode 12, 14 surface(s) reduce the transport of ions to the electrodes 12, 14, which undesirably increases the concentration overvoltage $\eta_c$. It was found that a rest period (i.e., no application of voltage), of e.g., about 15 minutes for every two hours of use of the electrolytic cell 10, was required to remove the gas bubbles from the electrolyte solution 26, and thus from around the electrodes 12, 14. Removal of the gas bubbles during the rest period was accomplished, e.g., by allowing the gas bubbles to naturally detach from the electrode(s) 12, 14, coalesce, and rise to the top of the electrolyte solution 26 during the rest period. Gas bubble removal was found to be desirable, so that new gas bubbles could form. The 15 minute rest period, however, was considered to be dead time in terms of operation efficiency, and such rest periods tended to reduce the overall output of hydrogen gas of the electrolytic cell 10. For instance, one example of a high pressure electrolytic cell exhibited an electric to hydrogen efficiency of less than about 60% when rest periods were utilized.

It was also found that during electrolysis, hydrogen gas tended to diffuse through the cell membrane 16 and into the compartment 30 within which oxygen gas was produced. This permeation may be driven by a concentration gradient of hydrogen and oxygen gas across the cell membrane 16. It is believed that hydrogen gas permeation decreased oxygen gas purity. It was found that the mixture of $H_2$—$O_2$ gas at high pressure in the oxygen-containing compartment 30 heated elastomeric hose(s) at the top of the cell 10 (e.g., the hose(s) making up, or part of the oxygen exit port 36), and that the heating deleteriously affected the useful operating life of the hose(s). One way to prevent the diffusion of the hydrogen gas through the membrane 16 was to reduce the pressure of the electrolytic cell 10, e.g., from about 6500 psi to about 2000 psi. However, this reduces the usefulness of the cell 10 as a FCEV fueling system, at least in part because a compressor would be required in order to boost the hydrogen output pressure to a desirable pressure level, e.g., greater than 6,500 psi, up to 10,000 psi, or to other comparable pressure levels that are sufficient to fuel a FCEV.

In some instances, the hydrogen storage container 32 may be situated directly next to the hydrogen containing compartment 24 of the electrolytic cell 10. The inventors have found that high electrolytic cell pressures may cause the electrolyte solution 26 to foam at the top of the cell 10. In this foam, the hydrogen gas is not released from the liquid electrolyte 26. This may cause the electrolyte solution 26 to spill out over the top of the cell 10 and, in some instances, into the hydrogen storage container 32, thereby contaminating the hydrogen gas.

Figure 3:
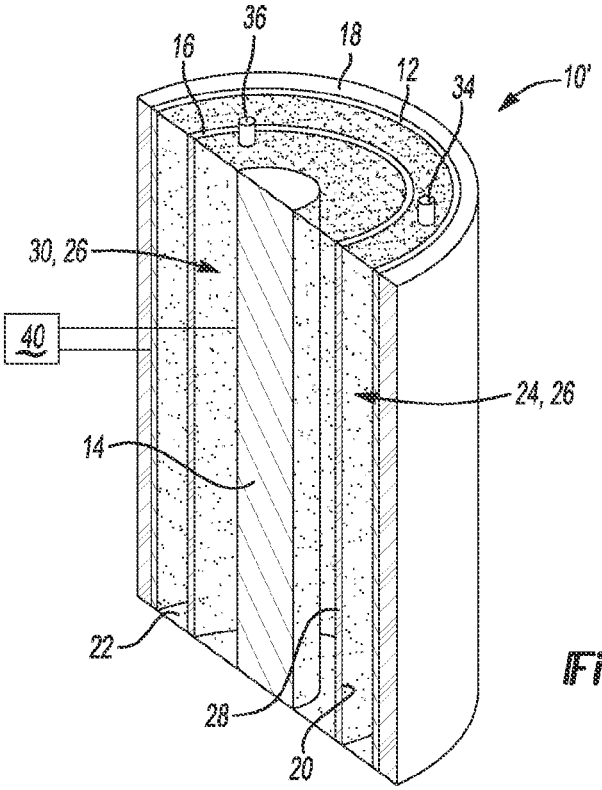
FIG. 3 is a cross-sectional, semi-schematic perspective view of another example of the electrolytic cell including a transducer that is directly attached to the positive electrode and to the negative electrode of the electrolytic cell.

The inventors of the present disclosure believe that the issues encountered and described above may be reduced or eliminated, and the efficiency of the electrolytic cell 10 may be improved by sonicating the electrolyte solution 26 during water electrolysis. Referring now to FIG. 3, which depicts an example of an electrolytic cell 10' of the present disclosure, it is believed that sonication of the electrolyte solution 26 induces cavitation and transportation of hydrogen and oxygen gas bubbles formed during electrolysis away from the respective surfaces of the negative electrode 12 and the positive electrode 14. As such, sonication of the electrolyte solution 26 improves bubble formation and gas transport, and also lowers the concentration overvoltage $\eta_c$ in the cell 10'. This reduces or even eliminates the need for rest periods and allows for operation of the electrolytic cell 10' at higher pressures (e.g., at a cell pressure of 2,000 psi or greater). For instance, an abundance of additional gas bubbles are formed during sonication. These additional bubbles collide with the hydrogen and oxygen gas bubbles present at or near the electrodes 12, 14, and transport the hydrogen and oxygen gas bubbles away from the electrodes 12, 14 toward the top of the cell 10'. In other words, the sonication promotes the formation of hydrogen and oxygen gas bubbles in their respective cell compartments 24, 30 and also promotes the movement of the hydrogen and oxygen gas bubbles out of their respective cell compartments 24, 30 so that they can be removed from the cell 10'. The removal of hydrogen and oxygen gas bubbles from the electrode surfaces enables new gas bubbles to form. In the cell 10', a rest period is unnecessary since sonication allows for continuous hydrogen and oxygen gas bubble removal and new hydrogen and oxygen gas bubble formation. As such, the efficiency and high pressure operation of the cell 10' is improved.

Sonication of the electrolyte solution 26 is accomplished by the direct oscillation of the negative electrode 12 and/or the positive electrode 14. As used herein, the term "oscillation" refers to the physical movement of the negative 12 and/or positive 14 electrodes to and fro from a reference position. The physical movement of the electrode(s) 12, 14 may include distinct changes in location of the electrode(s) 12, 14 as the electrode(s) 12, 14 move to and fro from a reference position, as well as vibrational motion of the electrode(s) 12, 14. Vibrational motion may include movement of the electrode(s) 12, 14 to and fro from a reference position without any distinct physical changes in an average location of the electrode(s) 12, 14. Vibration motion may include electrode 12, 14 quivering or trembling. In an example, direct oscillation of the electrode(s) 12, 14 is accomplished by applying vibrational energy directly to the electrode(s) 12, 14, where the vibrational energy is produced by a transducer 40 that is directly attached to the electrode(s) 12, 14. The cell 10' including the transducer 40 is shown in FIG. 3. In another example, direct oscillation of the electrode(s) 12, 14 is accomplished by applying vibrational energy directly to a cell housing, which forms both the wall 18 and the base 22. In this example, the vibrational energy is produced by a transducer 40 that is directly attached to the housing, which is directly attached to the electrode(s) 12, 14, through the wall 18 and/or the base 22.

As used herein, the term "directly attached" or the like refers to the attachment of the transducer 20 to the negative electrode 12 and/or to the positive electrode 14 with no intervening parts or through the cell housing (e.g., 18 and/or 22). In one example, the electrolytic cell 10' has a single transducer 40 that is directly attached to the negative electrode 12, directly attached to the positive electrode 14, or directly attached to both of the negative 12 and positive 14 electrodes. The latter example is shown in FIG. 3. In an example, the transducer 40 is directly attached to the electrode(s) 12, 14 by an electrical lead or wire. In another example, the electrolytic cell 10' may contain two transducers 40; where one of the transducers 40 is attached to the negative electrode 12 and the other transducer 40 is attached to the positive electrode 14. In still another example, the electrolytic cell 10' may contain a single transducer 40 that is attached to the electrodes 12, 14 through the cell housing.

Figures 4A, 4B, 4C:
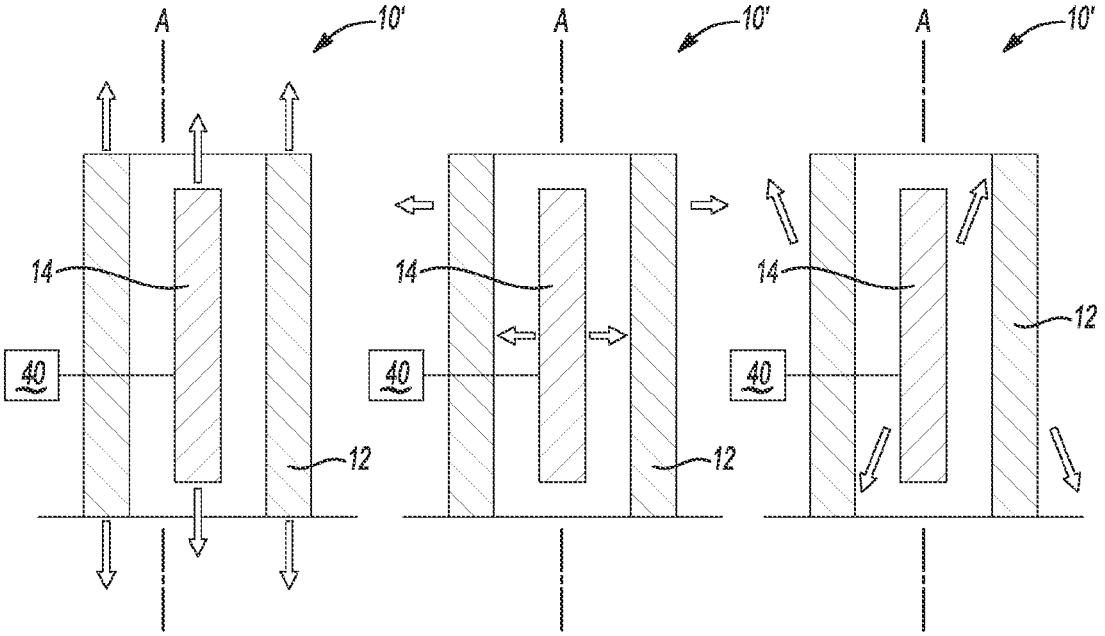
FIGS. 4A through 4C are cross-sectional, side views of the electrolytic cell, and schematically depict different examples of the electrolytic cell, where the positive and negative electrodes of the electrolytic cell oscillate parallel to an axis of the electrodes (FIG. 4A), perpendicular to an axis of the electrodes (FIG. 4B), and in a direction that is angularly offset from an axis of the electrodes (FIG. 4C)

Through its attachment to the negative electrode 12 and/or positive electrode 14, the transducer 40 transmits vibrational/sonic energy directly to the negative electrode 12 and/or positive electrode 14, and this vibrational energy causes the negative electrode 12 and/or positive electrode 14 to oscillate. Through its attachment to the cell housing, the transducer 40 transmits vibrational/sonic energy directly to the cell housing and to the negative electrode 12 and/or positive electrode 14 that is/are connected to the cell housing. In this example, the vibrational energy causes the cell housing, and the negative electrode 12 and/or positive electrode 14 to oscillate. The negative 12 and/or positive 14 electrodes may oscillate in a number of different patterns and/or directions, and some examples are schematically shown in FIGS. 4A through 4C. In the example shown in FIG. 4A, both the negative electrode 12 and the positive electrode 14 oscillate in a direction that is parallel to an axis A of the negative electrode 12 and the positive electrode 14. In the example shown in FIG. 4B, however, both the negative electrode 12 and the positive electrode 14 oscillate in a direction that is perpendicular to the axis A of the negative electrode 12 and the positive electrode 14. In yet another example, the negative electrode 12 and the positive electrode 14 may oscillate in a direction that is angularly offset from the axis A of the negative electrode 12 and the positive electrode 14. The direction of oscillation that is angularly offset includes any angle that is other than 0°, 90°, or 180° with respect to the axis A of the negative electrode 12 and the positive electrode 14. An example of the angularly offset oscillation of both the negative electrode 12 and the positive electrode 14 is shown in FIG. 4C, where the direction of oscillation is about 45° offset from 0° (which is along the axis A).

Although the examples shown in FIGS. 4A through 4C illustrate that both the negative electrode 12 and the positive electrode 14 oscillate, the cell 10' may be configured to otherwise oscillate one of the electrodes (e.g., the negative electrode 12) while keeping the other electrode (e.g., the positive electrode 14) stationary. When both of the electrodes 12, 14 oscillate, in yet another example, one of the electrodes (e.g., the negative electrode 12) may oscillate in one direction (e.g., parallel to axis A) while the other electrode (e.g., the positive electrode 14) may oscillate in another direction (e.g., perpendicular or angularly offset to axis A). Further, one or both of the electrodes 12, 14 may oscillate in a pattern including a two or more different directions either randomly or non-randomly. For instance, the positive electrode 14 may oscillate in a pattern that includes two strokes that are parallel to axis A and then two strokes that are perpendicular to axis A. It is also envisioned that one or more of the electrodes 12, 14 may oscillate in a circular or parabolic pattern.

Oscillation of the negative electrode 12 and/or the positive electrode 14 may be performed utilizing a magnetic field produced by magnets disposed on the outer surface of the cell 10'. This way, the wall 18 can remain sealed to prevent any pressure leakage of the electrolytic cell 10'. In an example, the electrolytic cell 10' may be constructed similar to a solenoid, where an electric coil is placed on the cell 10' and controls at least one magnet attached to each of the negative electrode 12 and the positive electrode 14. The electrode(s) 12, 14 would oscillate by a rapidly changing external magnetic field controlled by the electric coil. The electric coil in this example is the transducer 40. In another example, an electromagnet may be placed on the outside of the cell 10', and this electromagnet may produce a magnetic field that is sufficient to oscillate the electrode(s) 12, 14 each having at least one magnet or an article of some other type of magnetically susceptible material (e.g., a ferromagnetic material) placed thereon. The electrodes 12, 14 may otherwise be formed from a magnetic material, and the electromagnet on the outside of the cell 10' may control the oscillatory movement of the magnetic electrodes 12, 14. In this example, the electromagnet will generate an oscillatory magnetic field and the magnet will convert the magnetic field into the energy of physical motion. In this way, both the electromagnet and the magnet act as the transducer 40. Also in this example, the electromagnet and the electrodes 12, 14 may be separated by a non-magnetic membrane seal, which may be made from a dielectric or non-conductive material, such as a heavy ceramic or a polymeric material. The seal is used to avoid inducement of electric currents that may neutralize the outside magnetic field. In yet another example, an external electric field (e.g., an alternating current (AC) field) may be applied to a piezoelectric element/transducer attached to the top or bottom of each electrode 12, 14 to oscillate the electrodes 12, 14 to ultrasound frequencies.

The direction and/or pattern of oscillation of the negative 12 and/or positive 14 electrodes, as well as the amount of vibrational energy to be applied to the electrode(s) 12, 14 may be preset, e.g., by the manufacturer of the electrolytic cell 10'. In another example, the direction and/or pattern of oscillation and the amount of vibrational energy to be applied to the electrode(s) 12, 14 may be controlled by a processor (e.g., processor 38 in the system 100 of FIG. 6) running suitable computer program code. The processor 38 may be a microprocessor or other processing device that is selectively and operatively connected to the electrolytic cell 10'. Further details of the processor 38 are provided below in conjunction with a description of an example of a hydrogen fueling system 100.

The inventors of the present disclosure believe that the electrolyte solution 26 is sufficiently sonicated as a result of the oscillation of the negative electrode 12 and/or the positive electrode 14 caused by vibrational energy that is supplied directly thereto by the transducer(s) 40. Thus, sonication is performed without using any additional equipment, such as vibrating rods or tables. Further, the oscillations of the electrode(s) 12, 14 also detach the hydrogen and oxygen gas bubbles from the respective surfaces of the electrode(s) 12, 14 so that such bubbles can quickly rise to the top of the cell 10.

In an example, the transducer(s) 40 may be configured to transmit vibrational energy to the electrode(s) 12, 14 at a constant rate/substantially constant rate so that the electrode(s) 12, 14 will oscillate also at a constant rate/substantially constant rate. By the oscillation of the electrode(s) 12, 14, sonication of the electrolyte solution 26 therefore occurs at a fixed frequency. Sonication may occur, for instance, at a fixed frequency of greater than 20 kHz.

In an example, a frequency sweep may be used to eliminate any vibrational nodes produced by the oscillation of the electrode(s) 12, 14 at the constant rate/substantially constant rate. For instance, the amount of vibrational energy supplied to the electrode(s) 12, 14 may be adjusted so that sonication of the electrolyte solution 26 by the oscillation of the electrode(s) 12, 14 sweeps a frequency range (e.g., backwards and forwards) from infrasound to ultrasound.

In another example, an amount of vibrational energy may be supplied to the electrode(s) 12, 14 so that sonication of the electrolyte solution 26 occurs at a sweeping frequency consistently when the cell 10' is in use. It is believed that performing the sonication at a sweeping frequency will cause gas bubbles that have formed on the electrode(s) 12, 14 to readily coalesce into larger gas bubbles, and to readily separate from the electrode(s) 12, 14. Additionally, performing the sonication at a sweeping frequency will cause gas bubbles to more readily form in a gas-supersaturated region surrounding the electrode(s) 12, 14. It is believed that this is due to sonication overcoming at least one of the barriers to bubble formation.

In still another example, the vibrational energy may be supplied to the electrode(s) 12, 14 in pulses (on/off cycles). This will cause the electrode(s) 12, 14 to oscillate according to the rhythm of the pulsed vibrational energy that is being transmitted thereto. Sonication of the electrolyte solution 26 will thus occur in pulses according to the rhythm of the oscillating electrode(s) 12, 14. The cycle times for each electrode 12, 14 and the corresponding pulses applied to each electrode 12, 14 may coincide; however the cycle times and pulses for the electrodes 12, 14 do not have to be identical. It is believed that the on/off cycles of vibrational energy transmitted to the electrode(s) 12, 14 will minimize the amount of on-time experienced by the transducer 40, which reduces energy loss and improves the overall efficiency of the cell 10'.

The inventors of the present disclosure also believe that modifications to the respective surfaces of the negative electrode 12 and/or the positive electrode 14 will enhance the effects of sonication and bubble behavior. The surface modifications are believed to agitate the electrolyte solution 26 at a distance from a surface of the negative electrode 12 or the positive electrode 14. Agitation throughout the electrolyte solution 26 enhances the gas transport to the top of the cell 10'.

Figure 5A:
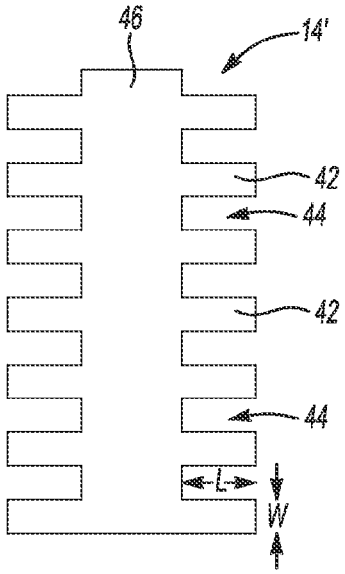
FIGS. 5A through 5C are side views of examples of a positive electrode of an example of the electrolytic cell, where each positive electrode has a modified surface geometry.
Figure 5B:
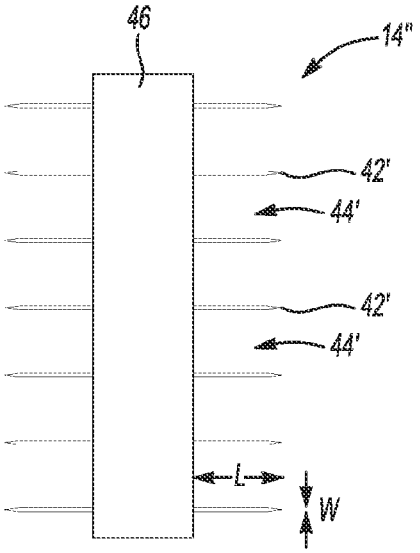
Figure 5C:
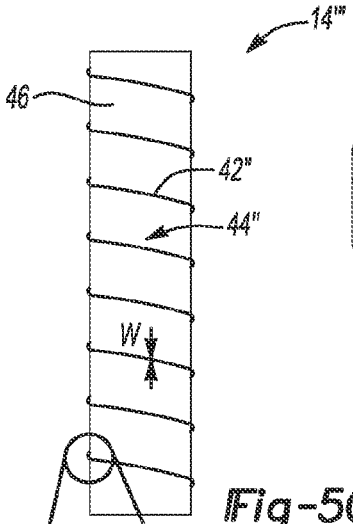
Figures 1, 5C:
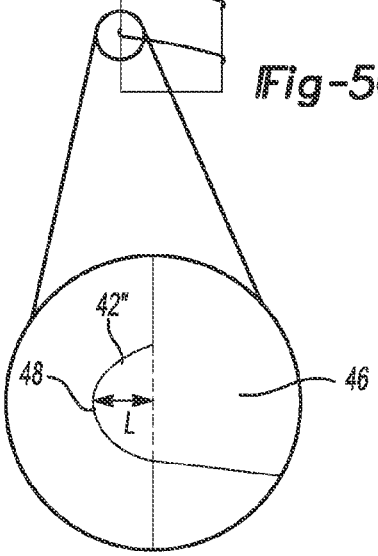

Example electrode surface modifications are shown in FIGS. 5A through 5C. For instance, as shown in FIGS. 5A and 5B, the surface of the positive electrode 14', 14" may be modified to include a number of protrusions 42, 42' and cavities 44, 44' defined between adjacent protrusions 44, 44'. Referring now to FIGS. 5C and 5C-1, the surface of the positive electrode 14'" may otherwise be modified to include a single protrusion 42" that wraps around an electrode body 46 in a screw-like pattern. In this example, a single cavity 44" is formed between the threads (formed by the protrusion 42") of the screw-like pattern.

It is to be understood that the electrode 12 may also or otherwise be modified as similarly described above for the electrode 14, 14', 14", 14'". In this case, any surface of the electrode 12 in contact with the electrolyte solution 26 may be modified. For instance, an interior surface of the electrode 12 may be modified.

The modified surface of the electrode(s) 12, 14 generally increases the surface area of the electrode(s) 12, 14 so that the vibrational/sonic energy (i.e., acoustic waves) can resonate inside the cavities (e.g., 44, 44', 44") and be amplified. In other words, the surface modification to the electrode(s) 12, 14 will alter the oscillatory frequency of the electrode(s) 12, 14, and the extent that the oscillatory frequency is altered depends, at least in part, on the depth of the resonant cavities. It is believed that the combination of the sonication frequency and the depth of the surface modifications (e.g., the cavities 44, 44', 44") of the electrode(s) 12, 14 will induce turbulence and/or cavitation of the electrolyte solution 26. It is further believed that the induction of cavitation reduces saturation of the hydrogen gas bubbles or oxygen gas bubbles formation, growth, and transport in the electrolyte solution 26 will be enhanced. The cavitation will also enable transport of the electrolyte to the electrode(s) 12, 14, which enhances the kinetics of the electrolytic cell 10'.

In the examples where the electrode(s) 12, 14 may have a surface modified by a number of protrusions, the protrusions 42, 42' can take any shape or configuration, including stud-like protrusions 42 (shown in FIG. 5A) and needle-like protrusions 42' (shown in FIG. 5B). The needle-line protrusions 42' may have pointy ends, round ends, square ends, or any other desirable geometric shape. It is believed that the needle-like protrusions 42' having square ends would increase the surface area of the protrusions 42'. The protrusions 42, 42' have a length L ranging from about 0.1 cm to about 0.5 cm, and have a width W ranging from about 0.5 cm to about 1.0 cm. Further, each of the resonant cavities 44, 44' has a width ranging from about 0.1 cm to about 1.0 cm. It is to be understood that the protrusions 42, 42' may be formed around the entire surface (i.e., the surface in contact with the electrolyte solution 26) of the electrode 12, 14 in a regular or non-regular pattern.

In the example where the electrode(s) 12, 14 has/have a surface modified to have a screw-like pattern, the protrusion 42" may have a length L (which is defined by the distance from the body 46 to the edge 48 of the protrusion 42", as shown in FIG. 5C-1) ranging from about 0.1 cm to about 0.5 cm, and a width W (which is defined as the thickness of the protrusion 42", as shown in FIG. 5C) ranging from about 0.5 cm to about 1.0 cm. Furthermore, the protrusion 42" may have a sharp edge 48, a rounded edge 48, a square edge 48, a hexagonal edge 48, etc.

The protrusions 42, 42', 42" may be formed from the same material as the respective bodies 46 of the negative electrode 12 and/or the positive electrode 14. In this example, the protrusions 42, 42', 42" are formed from a conductive or semi-conductive material that will focus the acoustic wave in a desirable manner. In an example, the protrusions 42, 42', 42" and the electrodes 12, 14 are formed from any conductive or semi-conductive material other than a precious metal.

In another example, the protrusions 42, 42', 42" are formed from a resonant material that is different from that of the respective bodies 46 of either the negative electrode 12 or the positive electrode 14. The resonant material is a non-conductive material, such as ceramics (e.g., glass) or plastics. These materials may also focus acoustic waves in a desirable manner.

An example of a method for making the electrolytic cell 10' will be described herein in conjunction with FIG. 3. The method involves modifying the surface of any of the negative electrode 12 or the positive electrode 14. Modification of the surface of the negative electrode 12 and/or the positive electrode 14 may be accomplished by machining, molding, or any other process sufficient to form the protrusion/s 42, 42', 42" and cavity/ies 44, 44', 44".

The positive electrode 14 is positioned inside the compartment 30 and the negative electrode 12 is positioned inside the compartment 24. The compartments 24, 30 are separated by the cell membrane 16, and thus the negative 12 and positive 14, 14', 14", 14'" electrodes are also separated by the cell membrane 16. Then, the electrolyte solution 26 is introduced into the compartments 24 and 30, and the electrolyte solution 26 is in contact with the cell membrane 16. In an example, the negative electrode 12 and/or the positive electrode 14 is/are directly attached to the transducer 40, e.g., via a wire, so that the transducer 40 can directly supply vibrational energy to the negative electrode 12 and/or the positive electrode 14. In another example, the cell housing is directly attached to the transducer 40, e.g., via a wire, so that the transducer 40 can directly supply vibrational energy to the negative electrode 12 and/or the positive electrode 14 attached to the cell housing (through the wall 18 and/or base 22).

Figure 6:
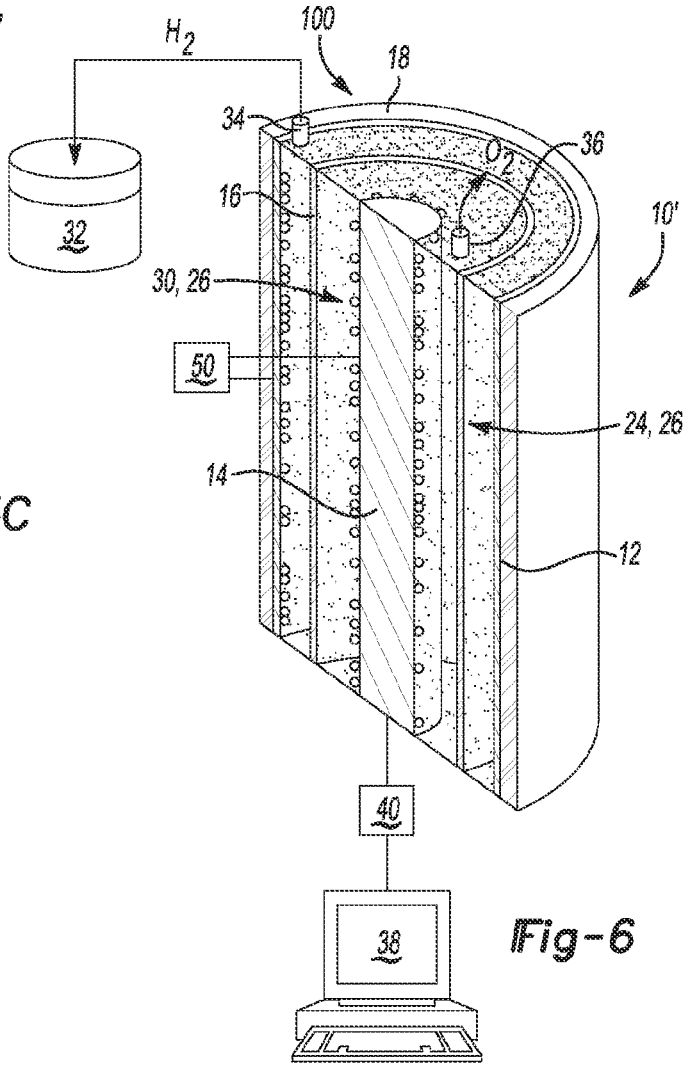
FIG. 6 schematically depicts an example of a hydrogen fueling system including a cross-sectional, semi-schematic perspective view of an electrolytic cell according to an example of the present disclosure.

An example of a hydrogen fueling system 100 is schematically depicted in FIG. 6. The hydrogen fueling system 100 may be incorporated into any device or system that utilizes electrolytically-produced hydrogen as fuel. In an example, the hydrogen fueling system 100 may be incorporated into a fuel cell electric vehicle (FCEV). The hydrogen fueling system 100 includes the electrolytic cell 10', the processor 38 to control the operation of the electrolytic cell 10', and a hydrogen storage container 32. Any of the examples of the electrolytic cell 10' that includes the transducer 40 may be used in the hydrogen fueling system 100. Further, the hydrogen storage container 32 may be a vessel or the like including suitable equipment (e.g., hoses, valves, etc. (not shown)) connected to the hydrogen exit port 34, and such equipment is configured to capture and collect hydrogen gas from the port 34 at the top of the cell 10'. Again, the hydrogen gas is generated during water electrolysis performed by the electrolytic cell 10'. Oxygen gas that is also generated during the water electrolysis may not be collected in a storage tank, but instead, may be vented to the atmosphere through the oxygen exit port 36.

The processor 38 is selectively and operatively connected to the electrolytic cell 10'. In an example, the processor 38 is selectively and operatively connected to the transducer(s) 40 of the cell 10' to control the amount of vibrational energy to be supplied to the electrode(s) 12, 14. In an example, by a program run/executed by the processor 38, the processor 38 will set the transducer(s) 40 to supply a constant predefined amount of vibrational energy to the electrode(s) 12, 14. In another example, by a program run/executed by the processor 38, the processor 38 may control the transducer(s) 40 so that pulses of vibrational energy are supplied to the electrode(s) 12, 14.

In yet another example, the processor 38 may be selectively and operatively connected to a number of components of the system 100, e.g., to obtain information from those components, and to utilize the information in a computer program in order to ultimately control the amount of vibrational energy to be supplied to the electrode(s) 12, 14. For instance, the processor 38, running a computer program, is capable of determining a point at which the electrolyte solution 26 is over saturated with hydrogen gas produced by the electrolysis reaction (i.e., too much hydrogen gas has been dissolved or trapped in the electrolyte solution 26). In this example, the processor 38, running a computer program, is also capable of determining that the transducer(s) 40 is/are not activated. After making these determinations, the processor 38, running a computer program, is capable of sending a command to the transducer(s) 40 to initiate the transmission of the vibrational energy using a pulse mode (e.g., pulses of vibrational energy are transmitted to the electrode(s) 12, 14) or a constant mode (i.e., vibrational energy is transmitted to the electrode(s) 12, 14 at a constant rate). In the first instance, the electrode(s) 12, 14 will begin to oscillate in pulses to induce hydrogen and/or oxygen gas movement. In the second instance, the electrode(s) 12, 14 will begin to oscillate continuously to induce hydrogen and/or oxygen gas movement. In this way, over saturation of hydrogen gas may be disrupted while minimizing energy loses of the system 100 by initiating the oscillation of the electrodes electrode(s) 12, 14 when gas transport is desirable as opposed to continuously (i.e., rather than running the transducer(s) 40 constantly).

In an example, the point at which the electrolyte solution 26 is over saturated with hydrogen gas may be determined by comparing a calculated pressure of the cell 10' with a measured pressure of the cell 10'.

The calculated pressure may be determined using the ideal gas law, PV=nRT. P is the calculated pressure, V is the volume of non-dissolved hydrogen gas, n is the calculated number of moles hydrogen gas, R is the gas constant, and T is the temperature of the cell 10' (e.g., ambient temperature). The volume of non-dissolved hydrogen gas may be determined using the solubility of hydrogen in the electrolyte, which can be looked up. In particular, dissolved hydrogen does not contribute to the gas pressure in the cell 10', and so one can subtract the volume of dissolved hydrogen from the volume of the cell 10' to determine the volume (gas space) of non-dissolved hydrogen. The calculated number of moles of hydrogen gas may be determined from the electric current measured by an ammeter 50 that is connected in series with the negative electrode 12. The relationship between the current read by the ammeter 50 and hydrogen production may be determined using Faraday's Law, where two moles of electrons make one mole of hydrogen gas (e.g., as shown in Equation 1). The number of coulombs that pass through the cell 10' may be determined directly from the number of amp×seconds that are applied to the cell 10'. Generally, one coulomb produces about $1\times10^{-4}$ of a mole of charge, so each coulomb would produce about $0.5\times10^{-4}$ moles of hydrogen gas. All of this information may be used to determine the calculated pressure, P.

The actual pressure of the cell 10' during operation may be measured using any suitable pressure measuring device. These pressure measurements may be routinely taken as the electrolytic cell 10' produces hydrogen gas.

The measured pressure may be subtracted from the calculated pressure. The measured pressure being much lower than the calculated pressure is indicative of the electrolyte solution being oversaturated.

Continuous readings may be taken from the ammeter 50 and the actual pressure of the container 32 may be continuously computed. From at least this information, the processor 38 may continuously examine the saturation level of the cell 10'. When the measured pressure falls below a threshold value (i.e., the calculated pressure, where such value is a saturation point before foaming occurs), the processor 38 will send a command to the transducer(s) 40 to initiate oscillation and sonication. While in operation either in pulse mode or continuous mode, the hydrogen gas will be released from the electrolyte solution 26. It is to be understood that the processor 38 will continue to compare the computed and actual pressures to determine when over saturation is no longer an issue. At this point, the processor 38 will send another command to the transducer(s) 40 to continue in pulse mode or return to a rest/off mode.

Reductions in super-saturation of the cell 10' reduce the occurrence of foaming at the top of the cell 10', reduce hydrogen gas permeation, increase gas purity, decrease maintenance, and increase cell 10' pressure operation.

While several examples have been described, it will be apparent to those skilled in the art that the disclosed examples may be modified. Therefore, the foregoing description is to be considered non-limiting.

The invention claimed is:

1. An electrolytic cell, comprising:

a positive electrode disposed in an electrolytic compartment;

a negative electrode disposed in an other electrolytic compartment, wherein the negative electrode or the positive electrode has a modified surface geometry including protrusions separated by resonant cavities, the protrusions having a length ranging from about 0.1 cm to about 0.5 cm, and having a width of about 1.0 cm, and the resonant cavities having a width ranging from about 0.1 cm to about 1.0 cm;

a cell membrane positioned between the electrolytic compartment with the positive electrode disposed therein and the other electrolytic compartment with the negative electrode disposed therein;

an electrolyte solution disposed inside the electrolytic compartment with the positive electrode disposed therein and inside the other electrolytic compartment with the negative electrode disposed therein, the electrolyte solution also being in contact with the cell membrane;

a first transducer directly attached to the negative electrode; and a second transducer directly attached to the positive electrode, wherein vibrational energy selectively transmitted to the negative electrode and the positive electrode by the first and second transducers causes a) both the negative electrode and the positive electrode to respectively oscillate in a same direction, and b) bubbles to form and to separate i) hydrogen gas bubbles from a surface of the negative electrode and ii) oxygen gas bubbles from a surface of the positive electrode.

2. An electrolytic cell, comprising:

a positive electrode disposed in an electrolytic compartment;

a negative electrode disposed in an other electrolytic compartment, wherein:

the negative electrode or the positive electrode has a single protrusion that wraps around a body of the negative electrode or the positive electrode in a screw-shaped geometry;

the single protrusion has a length, which is defined by a spaced distance from the body to an edge of the protrusion, ranging from about 0.1 cm to about 0.5 cm; and the single protrusion has a width, defined by a thickness of a material that forms the single protrusion, ranging from about 0.5 cm to about 1.0 cm;

a cell membrane positioned between the electrolytic compartment with the positive electrode disposed therein and the other electrolytic compartment with the negative electrode disposed therein;

an electrolyte solution disposed inside the electrolytic compartment with the positive electrode disposed therein and inside the other electrolytic compartment with the negative electrode disposed therein, the electrolyte solution also being in contact with the cell membrane;

a first transducer directly attached to the negative electrode; and a second transducer directly attached to the positive electrode, wherein vibrational energy selectively transmitted to the negative electrode and the positive electrode by the first and second transducers causes a) both the negative electrode and the positive electrode to respectively oscillate in a same direction, and b) bubbles to form and to separate i) hydrogen gas bubbles from a surface of the negative electrode and ii) oxygen gas bubbles from a surface of the positive electrode.

3. The electrolytic cell as defined in claim 2 wherein the protrusion is formed of a material that forms the negative electrode or the positive electrode.

4. The electrolytic cell as defined in claim 2 wherein the protrusion is formed of a resonant material that is different from that of either the positive electrode or the negative electrode.

5. The electrolytic cell as defined in claim 4 wherein the resonant material is nonconductive, and is chosen from ceramics and plastics.

6. The electrolytic cell as defined in claim 2 wherein i) the same direction is parallel to an axis of each of the negative electrode and the positive electrode, or ii) the same direction is perpendicular to an axis of each of the negative electrode and the positive electrode, or iii) the same direction is angularly offset from an axis of each of the negative electrode and the positive electrode, wherein the angularly offset direction is an angle other than 0°, 90°, or 180° with respect to the axis of each of the negative electrode and the positive electrode.

7. A method for making the electrolytic cell of claim 2, the method comprising:

separating the negative electrode from the positive electrode with the cell membrane;

introducing the electrolyte solution into a space defined between the positive electrode and the negative electrode and in contact with the cell membrane; and respectively directly attaching the negative electrode and the positive electrode to the first and second transducers such that vibrational energy is to be selectively supplied from the first and second transducers to the negative electrode and the positive electrode.

8. A method for enhancing performance of the electrolytic cell as defined in claim 1, the method comprising:

sonicating the electrolyte solution by directly oscillating the negative electrode and the positive electrode in contact with the electrolyte solution in the same direction, thereby inducing cavitation and transportation of i) the hydrogen gas bubbles from the surface of the negative electrode and ii) the oxygen gas bubbles from the surface of the positive electrode;

wherein the direct oscillation is accomplished using the first and second transducers that are respectively directly connected to the negative electrode and the positive electrode.

9. The method as defined in claim 8 wherein the sonicating is performed at i) a fixed frequency, or ii) a pulsed frequency.

10. The method as defined in claim 8 wherein the sonicating is performed at a sweeping frequency ranging from infrasound to ultrasound.

11. The method as defined in claim 8 wherein i) the same direction is parallel to an axis of each of the negative electrode and the positive electrode, or ii) the same direction is perpendicular to an axis of each of the negative electrode and the positive electrode, or iii) the same direction is angularly offset from an axis of each of the negative electrode and the positive electrode, wherein the angularly offset direction is an angle other than 0°, 90°, or 180° with respect to the axis of each of the negative electrode and the positive electrode.

12. The method as defined in claim 8, further comprising agitating the electrolyte solution at a distance from the surface of any of the negative electrode or the positive electrode.

13. The method as defined in claim 12, further comprising altering an oscillatory frequency of the any of the negative electrode or the positive electrode based on a depth of the resonant cavities, thereby transporting the electrolyte solution to the surface of the any of the negative electrode or the positive electrode and enhancing kinetics of the electrolytic cell.

14. The method as defined in claim 8 wherein the inducing of cavitation reduces saturation of the hydrogen gas bubbles or oxygen gas bubbles in the electrolyte solution.

15. The method as defined in claim 8 wherein the sonicating is accomplished in a manner sufficient to transmit a constant rate of the vibrational energy to the negative electrode and the positive electrode to thereby oscillate the negative electrode and the positive electrode at a constant rate.

16. The method as defined in claim 8 wherein while the first and second transducers are in a non-oscillating mode, the further comprises:

by a processor executing computer readable code embedded on a non-transitory, tangible computer readable medium, determining a point at which the electrolyte solution is over saturated with hydrogen gas; and in response to the determining, transmitting a command to the first and second transducers to initiate a pulse mode whereby vibrational energy is pulsed to the negative electrode and the positive electrode.

17. The method as defined in claim 16 wherein the determining of the point at which the electrolyte solution is over saturated with the hydrogen gas is accomplished, by the processor, by:

calculating an expected pressure of the cell;

measuring an actual pressure of the cell; and comparing the calculated pressure with the measured pressure.

18. A hydrogen fueling system, comprising:

an electrolytic cell, comprising:

a positive electrode disposed in an electrolytic compartment;

a negative electrode disposed in an other electrolytic compartment, wherein the negative electrode or the positive electrode has a modified surface geometry including protrusions separated by resonant cavities, the protrusions having a length ranging from about 0.1 cm to about 0.5 cm and having a width of about 1.0 cm, and the resonant cavities having a width ranging from about 0.1 cm to about 1.0 cm;

a cell membrane positioned between the electrolytic compartment with the positive electrode disposed therein and the electrolytic compartment with the negative electrode disposed therein;

an electrolyte solution disposed inside the electrolytic compartment with the positive electrode disposed therein and inside the other electrolytic compartment with the negative electrode disposed therein, the electrolyte solution also in contact with the cell membrane;

a first transducer directly attached to the negative electrode;

a second transducer directly attached to the positive electrode, wherein vibrational energy is selectively transmitted by the first and second transducers to the negative electrode and the positive electrode, the vibrational energy to cause a) both the negative electrode and the positive electrode to respectively oscillate in a same direction, and b) bubbles to form and to separate i) hydrogen gas bubbles from a surface of the negative electrode and ii) oxygen gas bubbles from a surface of the positive electrode; and a processor selectively and operatively connected to the electrolytic cell, the processor including:

computer readable code for determining a point at which the electrolyte solution disposed in the electrolytic compartment with the positive electrode disposed therein is over saturated with hydrogen gas; and computer readable code for sending a command to the first and second transducers to transmit pulses of the vibrational energy to the positive electrode and the negative electrode;

the computer readable code being embedded on a non-transitory, tangible computer readable medium.

19. The hydrogen fueling system as defined in claim 18 wherein before receiving the command, the first and second transducers are in a non-oscillating mode.

20. The hydrogen fueling system as defined in claim 18, further comprising a hydrogen storage tank to receive hydrogen gas produced by the electrolytic cell.

21. The electrolytic cell as defined in claim 2 wherein the electrolytic cell contains and outputs hydrogen gas at a pressure of at least 6500 psi.

22. The electrolytic cell as defined in claim 1 wherein the protrusions are formed of a material that forms the negative electrode or the positive electrode.

23. The electrolytic cell as defined in claim 1 wherein the protrusions are formed of a resonant material that is different from that of either the positive electrode or the negative electrode.

24. The electrolytic cell as defined in claim 23 wherein the resonant material is nonconductive, and is chosen from ceramics and plastics.

* * * * *